US005688333A

United States Patent [19]

Schelwald

[11] Patent Number: 5,688,333

[45] Date of Patent: Nov. 18, 1997

[54] METHOD OF BULK WASHING AND DRYING OF DISCRETE COMPONENTS

[75] Inventor: Peter J.E. Schelwald, Stadskanaal, Netherlands

[73] Assignee: U.S. Philips Corporation, New York, N.Y.

[21] Appl. No.: 579,651

[22] Filed: Dec. 27, 1995

[30] Foreign Application Priority Data

Dec. 27, 1994 [EP] European Pat. Off. ..... 94203765

[51] Int. Cl.[6] ..... B08B 3/00; B08B 7/00

[52] U.S. Cl. ..... 134/4; 134/5; 134/21; 134/25.1; 134/30; 34/289

[58] Field of Search ..... 134/4, 5, 11, 21, 134/19, 25.7, 25.4, 30; 34/289, 287

[56] References Cited

U.S. PATENT DOCUMENTS

| | | | |
|---|---|---|---|
| 3,259,991 | 7/1966 | Illich, Jr. | 34/289 |
| 3,264,747 | 8/1966 | Fuentevilla | 34/289 |
| 3,728,798 | 4/1973 | Wehrmann | 34/92 |
| 3,740,860 | 6/1973 | Smith, Jr. | 34/289 |
| 4,409,034 | 10/1983 | Williams | 134/4 |
| 4,871,417 | 10/1989 | Nishizawa et al. | 134/21 X |
| 4,962,776 | 10/1990 | Liu et al. | 134/11 |
| 4,977,688 | 12/1990 | Roberson, Jr. et al. | 134/21 X |
| 5,505,007 | 4/1996 | Raeckers | 34/289 |

FOREIGN PATENT DOCUMENTS 6224116 8/1994 Japan .

*Primary Examiner*—Robert J. Warden
*Assistant Examiner*—Saeed Chaudhry
*Attorney, Agent, or Firm*—Brian J. Wieghaus

[57] ABSTRACT

A method of washing and drying of discrete components in bulk, wherein the components are washed with a cleaning liquid and the wet components are dried in a freeze-drying process by bringing the wet components to a temperature below the melting point of the cleaning liquid, so that the cleaning liquid becomes a solid substance, and by evaporating the solid substance through introduction of the components and the solid substance into a space having a pressure lower than the vapour pressure of the solid substance.

7 Claims, 1 Drawing Sheet

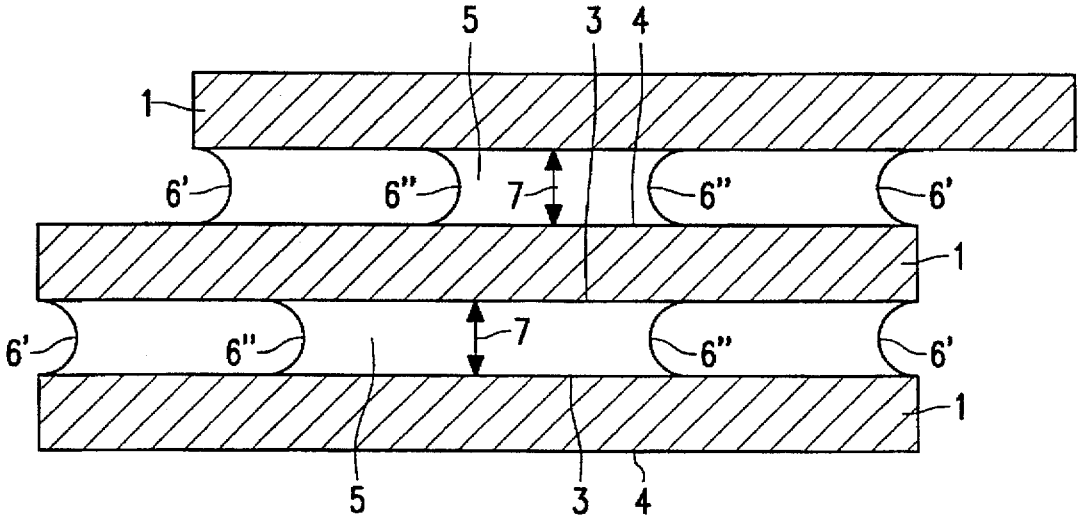
5
3
4
1
6'
6"
7
6"
6'
1
6'
6"
7
6"
6'
1
5
3
4

METHOD OF BULK WASHING AND DRYING OF DISCRETE COMPONENTS

BACKGROUND OF THE INVENTION

The invention relates to a method of bulk washing and drying of discrete components.

Discrete components are components which are used individually. These are components such as ceramic substrates, capacitors, resistors, or semiconductor crystals. These components in practice undergo many treatments such as, for example, polishing or etching. After many such treatments, the discrete components are to be divested of the (liquid) substances which were used during the treatments. It is accordingly usual in many stages of manufacture to wash the components with a cleaning liquid and subsequently dry the wet components and process them further. The discrete components are treated in bulk, i.e. the components are treated without spacers as a mass commodity.

The method described has the disadvantage that components stick together after drying of the components. To prevent this sticking, organic solvents such as alcohol or acetone are used in practice to drive away the cleaning liquid. The use of organic solvents, however, is undesirable. Such solvents may pollute the environment, so that measures are necessary for recycling the used organic solvents or discharge them in an environmentally friendly way. In addition, the use of these solvents is expensive, also because safety measures are necessary during their use.

SUMMARY OF THE INVENTION

The invention has for its object inter alia to provide a method of washing and drying discrete components whereby the components do not stick together after drying, while no organic solvents are necessary.

According to the invention, the method is for this purpose characterized in that the components are washed with a cleaning liquid and the wet components are dried in a freeze-drying process in that the wet components are brought to a temperature below the melting point of the cleaning liquid, so that the cleaning liquid becomes a solid substance, and in that the solid substance is evaporated through introduction of the components and the solid substance into a space having a pressure lower than the vapour pressure of the solid substance.

It is achieved thereby that the components are washed and dried without the use of organic solvents, while the components do not stick together after drying.

Although in principle various kinds of cleaning liquids may be used, water is preferably used as the cleaning liquid. Water is harmless to the environment, cheap and readily available, while the melting point and vapour pressure of water render it highly suitable for freeze-drying.

It is suspected that the following physical processes play a part. When water is used as the cleaning liquid in the known method, a water film will be present between the wet components. If these wet components were dried without further measures, the water will evaporate along edges of the wet components which are in communication with their surroundings. Between the discrete components, however, a water film remains present owing to the capillary action of spaces between the components. These spaces become narrower during evaporation. In proportion as more water evaporates along edges, the capillary forces pull the components increasingly closer together. When practically all water has disappeared, the components stick together so tight through adhesion that they cannot or only with difficulty be separated. In the known method, accordingly, the water is not evaporated but driven away through the use of an organic solvent, for example acetone, as a water repellent. The solvent evaporates so quickly that capillary forces play a minor role. In addition, the surface structure of the component changes owing to the use of the solvent. Other molecular groups will then be present at the surface of the component compared with the situation in which water only is used. This influences the adhesion between the components.

When the method according to the invention is used, a solid substance such as ice is present between the components during evaporation. The solid substance evaporates along the edges to the surroundings, but the components remain at a comparatively large distance from one another, separated by the non-evaporated solid substance. The components are not drawn towards one another by capillary forces, while in addition the solid substance can evaporate better owing to the permanent, comparatively great distance between the components than in the known method where the edges become ever narrower owing to capillary forces.

The method may be used with comparatively small discrete components having dimensions below approximately 0.5 mm. Sticking together after drying occurs particularly with small discrete components. Preferably, the method is used for components which are provided with at least one plane surface. A plane surface is understood to mean here a surface having an out-of-flatness smaller than approximately 30 μm. Sticking together also often occurs with larger discrete components having plane surfaces because the wet components orient themselves owing to capillary forces such that their plane surfaces run parallel, a film of the cleaning liquid being present between two plane surfaces. When these wet components are dried without further measures, the cleaning liquid will evaporate along an edge between the plane surfaces which is in connection with the surroundings. The plane surfaces are then drawn together increasingly as more cleaning liquid evaporates. The surfaces accordingly stick together through adhesion. In the method according to the invention, non-evaporated solid substance provides a comparatively wide separation between the components.

Preferably, the method is used for components having a plate shape with two mutually opposed plane main surfaces. The dimensions of the component in a direction perpendicular to the planes are small here compared with the dimensions parallel to the planes. Practice has shown that particularly components having this shape, for example ceramic or glass substrates, often stick together after drying without the use of organic solvents. The method may be used to advantage especially in the manufacture of semiconductor crystals, where bulk-supplied wet crystals, for example diodes or transistors, are washed and dried. Such semiconductor crystals have a plate shape with smooth surfaces which show a strong mutual adhesion, so that sticking together of crystals after drying without the use of organic solvents occurs frequently. In the method according to the invention, semiconductor crystals may be washed and dried without crystals sticking together after drying and without organic solvents being used.

Preferably, the pressure in the space lies between 500 and 1 Pa, so-called rough vacuum. In practice, a pressure of 10 Pa (0.1 mbar) is satisfactory. Such a pressure is sufficiently low for enabling a comparatively quick evaporation of, for example, ice, while this pressure can be realised in a comparatively simple and inexpensive manner by means of a so-called preliminary vacuum pump. For example, a so-called Roots blower may be used as the preliminary vacuum pump. Such a pump has a comparatively high pumping speed, so that large quantities of vapour can be discharged, if necessary.

It is found in practice that the evaporation of the solid substance removes so much heat from the components that the temperature of the components drops to a point where the evaporation becomes very slow. Preferably, accordingly, the components are heated during evaporation of the solid substance. When water is used as the cleaning liquid, the components and the ice are preferably heated to a temperature of approximately −10° C. in order to realise a quick evaporation of the ice.

BRIEF DESCRIPTION OF THE DRAWINGS

The invention will be explained in more detail below by way of example with reference to a drawing. The FIGURE therein shows components which are dried by the method according to the invention.

The FIGURE is purely diagrammatic and not drawn to scale.

DETAILED DESCRIPTION OF THE EMBODIMENTS

The FIGURE shows components 1 having at least one plane surface, in this example components 1 with a plate shape and two mutually opposed plane main surfaces 3, 4. The components 1 in this example comprise diode semiconductor crystals wherein a pn junction is provided parallel to the main surfaces 3, 4. Such semiconductor crystals 1 have a plate shape with a thickness of approximately 300 μm and a cross-section of 1 mm, with very smooth surfaces 3, 4 with a surface roughness <5 μm. During manufacture of the diodes, the components 1 undergo treatments such as, for example, gluing, sandblasting, or polishing, etc. After such treatments the components 1 are to be cleaned. A step in the cleaning process is washing of the components 1 in demineralised water, after which the wet components are dried. During washing and drying, the components are provided in bulk, i.e. they are tipped as a bulk commodity into a common holder for many components 1 without spacers, racks or the like. According to the invention, the wet components 1 are dried in a freeze-drying process in that the wet components are brought to a temperature below 0° C., so that ice 5 is formed, after which the ice 5 is evaporated. The ice 5 is evaporated in that the wet components 1 are introduced into a space having a pressure lower than the vapour pressure of water at 0° C. (approximately 600 Pa); in the present example a few hundred thousand such semiconductor diode crystals are brought into the space. The space is in connection with a so-called preliminary vacuum pump, a Roots blower, which brings the pressure in the space to approximately 10 Pa (0.1 mbar), so-called rough vacuum. This causes ice of the crystals to evaporate. The removal of evaporation heat from the components 1 causes the temperature of the components to fall as low as −50° C. The evaporation of the ice 5 becomes very slow at such a low temperature. During the evaporation of the ice 5, therefore, the components are heated to a temperature of approximately −10° C. in order to realise a quick evaporation of the ice 5. The components and the ice are for this purpose placed on a heater plate which is held at a temperature of approximately 30° C. The FIGURE shows components 1 which have so oriented themselves relative to one another as wet components 1 that a water film has formed between the surfaces 3, 4 owing to capillary forces. After freezing, ice 5 will be present between the plane surfaces 3, 4. The ice 5 evaporates along the open edges 6 which are in communication with the surroundings, in this case the space at a reduced pressure of 10 Pa. As the ice 5 evaporates, the open edge 6 moves from position 6' to position 6". The plane surfaces 3, 4 of the components 1, however, remain at a comparatively great, fixed distance 7 from one another because the non-evaporated ice 5 keeps the components apart. It is found that the components 1 can be dried without sticking together through the use of the method according to the invention.

The invention is not limited to the embodiment described above. The embodiment involves the drying of a diode semiconductor crystal. It will be obvious that other components such as, for example, small discrete components or components such as glass or ceramic substrates each provided with at least one plane surface may be dried by the method according to the invention without sticking together of components after drying. It is also possible to use the evaporation process for cooling down the cleaning liquid so far that a solid substance arises. The removal of evaporation heat from the wet components then cools these components down until the cleaning liquid becomes a solid substance. Freeze-drying is a process which is known per se. In known freeze-drying processes, a substance such as a food is divested of water, so that the food has better storage properties. Water is added again when the food is to be used. Water was used as the cleaning liquid in the embodiment. The wet discrete components may also be freeze-dried in the case of other cleaning liquids. Standard freeze-drying processes and equipment may be used for freezing-in of the wet discrete components and for evaporating the ice.

What is claimed is:

1. A method of bulk washing and drying of discrete components, characterized in that the components are washed with a cleaning liquid to produce wet components, the cleaning liquid having a melting point, and the wet components are dried in a freeze-drying process in that the wet components are brought to a temperature below the melting point of the cleaning liquid, so that the cleaning liquid becomes a solid substance, the solid substance having a vapour pressure, and in that the solid substance is evaporated through introduction of the components and the solid substance into a space having a pressure lower than the vapour pressure of the solid substance.

2. A method as claimed in claim 1, characterized in that the cleaning liquid comprises water.

3. A method as claimed in claim 1, characterized in that components are dried and washed which are each provided with at least one plane surface.

4. A method as claimed in claim 1, characterized in that the components have a plate shape with two mutually opposed plane main surfaces.

5. A method as claimed in claim 1, characterized in that the components comprise semiconductor crystals.

6. A method as claimed in claim 1, characterized in that the pressure in said space lies between 500 Pa and 1 Pa.

7. A method as claimed in claim 1, characterized in that the components and the solid substance are heated during the evaporation of the solid substance.

* * * * *